US010518949B2

(12) United States Patent
Becker

(10) Patent No.: US 10,518,949 B2
(45) Date of Patent: Dec. 31, 2019

(54) LID ASSEMBLY WITH A JAR SLEEVE AND A LID

(71) Applicant: Scott Becker, Appleton, WI (US)

(72) Inventor: Scott Becker, Appleton, WI (US)

( * ) Notice: Subject to any disclaimer, the term of this patent is extended or adjusted under 35 U.S.C. 154(b) by 0 days.

(21) Appl. No.: 15/916,637

(22) Filed: Mar. 9, 2018

(65) Prior Publication Data

US 2019/0276208 A1 Sep. 12, 2019

(51) Int. Cl.

| | |
|---|---|
| ***B65D 43/08*** | (2006.01) |
| ***B65D 51/24*** | (2006.01) |
| ***B65D 43/02*** | (2006.01) |
| *B65D 41/16* | (2006.01) |

(52) U.S. Cl.

CPC ..... *B65D 51/246* (2013.01); *B65D 43/0231* (2013.01); *B65D 2543/0024* (2013.01); *B65D 2543/00092* (2013.01); *B65D 2543/00537* (2013.01); *B65D 2543/00842* (2013.01)

(58) Field of Classification Search

CPC ..... B65D 51/246; B65D 43/0231; B65D 2543/00092; B65D 2543/0024; B65D 2543/00537; B65D 2543/00842

USPC ..... 220/697, 700, 735, 736, 212.5, 212, 220/254.7, 256.1, 793; 215/227, 305, 391

See application file for complete search history.

(56) References Cited

U.S. PATENT DOCUMENTS 1,598,443 A * 8/1926 Horan ..... A47G 21/14 206/207
1,682,571 A * 8/1928 Horan ..... A47G 21/14 206/207
1,734,444 A * 11/1929 Paulson ..... B27G 11/02 215/227
2,175,735 A * 10/1939 Banks ..... A47G 19/186 141/112
2,776,691 A * 1/1957 Tupper ..... A47J 43/27 220/23.83
4,865,188 A * 9/1989 Custeau ..... B44D 3/006 206/209
5,251,774 A 10/1993 Engle
5,738,242 A * 4/1998 Paris ..... A47G 21/145 220/735
5,833,928 A * 11/1998 Ratajczak ..... A61B 10/0096 422/534
5,893,489 A * 4/1999 Giarrante ..... B44D 3/127 220/254.8
6,041,919 A * 3/2000 Adams ..... A45D 34/046 206/15.2

(Continued)

FOREIGN PATENT DOCUMENTS

EP 3117795 A1 1/2017

OTHER PUBLICATIONS

Products found on the Internet.

*Primary Examiner* — J. Gregory Pickett
*Assistant Examiner* — Niki M Eloshway
(74) *Attorney, Agent, or Firm* — James Earl Lowe, Jr.

(57) ABSTRACT

A lid assembly and a knife adapted to be attached to a jar, the lid assembly including: a cylindrical jar sleeve adapted to be secured to the open end of the jar and having a jar sleeve circumferential portion at the upper end thereof. The lid assembly also includes a lid adapted to be removably attached to the jar sleeve and having a lid circumferential portion, one of the lid and jar sleeve having a groove adapted to receive the circumferential portion of the other of the lid and jar sleeve.

5 Claims, 7 Drawing Sheets

(56) References Cited

U.S. PATENT DOCUMENTS

| | | | | |
|---|---|---|---|---|
| 6,213,329 | B1 | 4/2001 | Dobson | |
| 6,494,315 | B2 | 12/2002 | Frisk | |
| 6,761,283 | B1 | 7/2004 | Gilliam et al. | |
| 7,644,832 | B1 * | 1/2010 | Tsengas | B65D 43/0208 220/212 |
| 8,132,685 | B2 * | 3/2012 | Wellman | B65D 41/3495 215/344 |
| 2005/0084360 | A1 | 4/2005 | Panasik et al. | |
| 2005/0218141 | A1 | 10/2005 | Kratzer et al. | |
| 2008/0217333 | A1 | 9/2008 | Mayo et al. | |
| 2009/0139042 | A1 * | 6/2009 | Ruzumna | A46B 17/06 15/184 |
| 2011/0163102 | A1 * | 7/2011 | Haynie | B65D 51/28 220/521 |
| 2013/0001184 | A1 * | 1/2013 | Groubert | B65D 47/0828 215/235 |
| 2013/0334225 | A1 * | 12/2013 | Ekkert | B65D 51/1633 220/256.1 |
| 2015/0164253 | A1 * | 6/2015 | Taylor | A47G 19/2272 220/212 |
| 2015/0210450 | A1 * | 7/2015 | Mercado | B65D 51/228 220/258.2 |

* cited by examiner

LID ASSEMBLY WITH A JAR SLEEVE AND A LID

FIELD OF THE INVENTION

The present disclosure relates to containers for holding food stuff, such as jam, peanut butter and mayonnaise. More particularly, this disclosure is directed to a container which improves the ability of a user to use the food stuff in the container.

BACKGROUND OF THE INVENTION

When using containers for spreadable foodstuff, especially away from home, it can difficult to use the foodstuff, for one often needs to safely put a lid down, without contaminating it. And one likewise needs something to spread the foodstuff with, like a knife. But where do you put the knife when you aren't using it, so that it too doesn't get contaminated? And how do one provide a ready solution to avoid contamination for off the shelf jars of spreadable foodstuff, such as jam, peanut butter and mayonnaise?

Current container offerings do not provide a ready solution. Earlier solutions, such as that disclosed in Bloom U.S. Pat. No. 1,834,085, do not provide for limiting contamination, easy removal and replacement of a lid, and for use of such a lid with jars with different threads.

SUMMARY OF THE INVENTION

Disclosed is a lid assembly and a knife adapted to be attached to a jar, the lid assembly including: a cylindrical jar sleeve adapted to be secured to the open end of the jar and having a jar sleeve circumferential portion at the upper end thereof. The lid assembly also includes a lid adapted to be removably attached to the jar sleeve and having a lid circumferential portion, one of the lid and jar sleeve having a groove adapted to receive the circumferential portion of the other of the lid and jar sleeve.

In the preferred embodiment, this product replaces the screw on lid of a jam, peanut butter, mayonnaise or like foodstuff jar assembly and converts the jar into an assembly with a built-in spreader.

Figure 1:
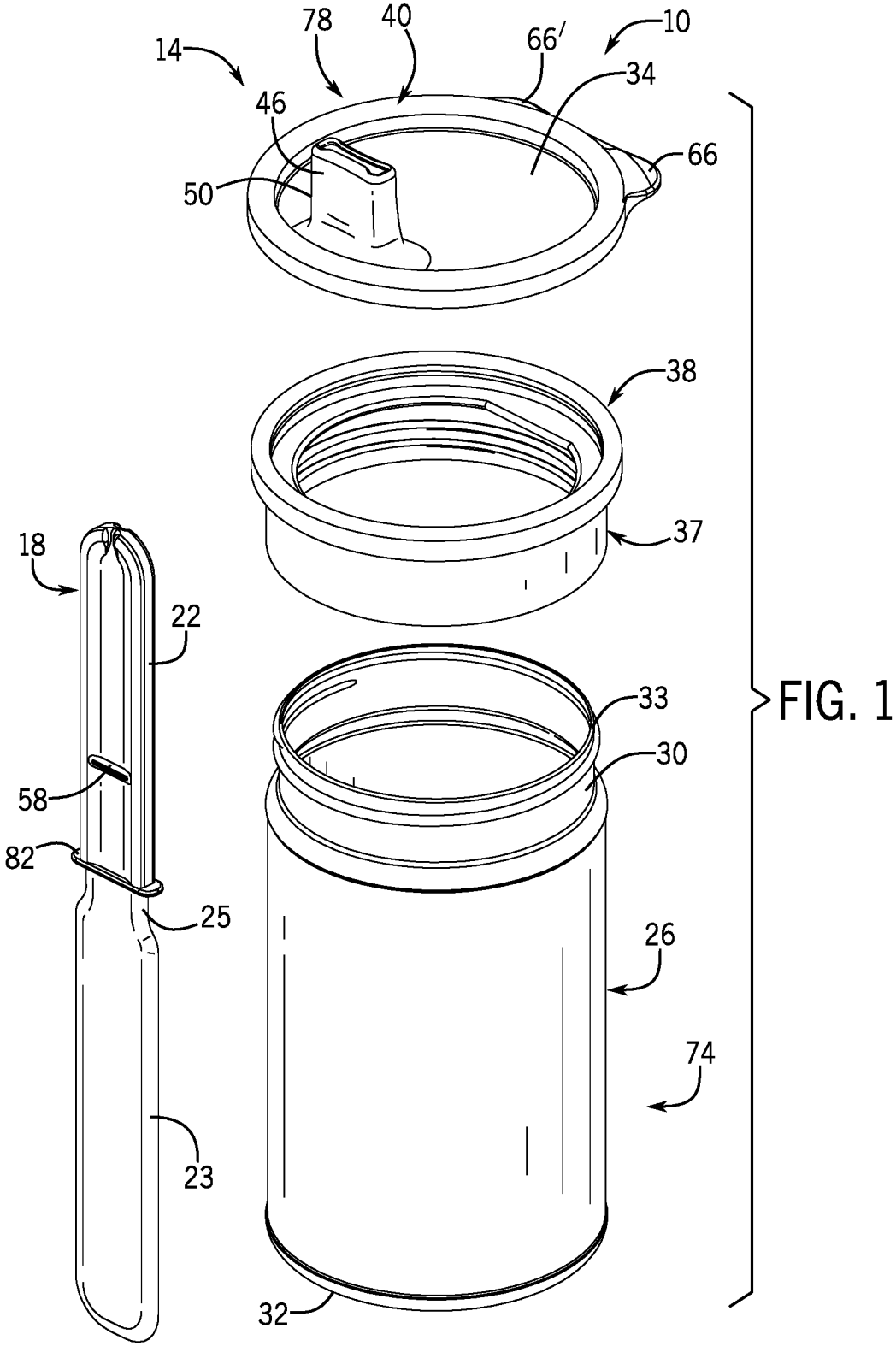
FIG. 1 is an exploded side perspective view of a jar assembly including a jar, and a lid and knife assembly comprising a knife and a lid assembly according to this disclosure.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward", "downward", "side", "top" and "bottom", etc., are words of convenience and are not to be construed as limiting terms.

DETAILED DESCRIPTION

As illustrated in the FIGS. 1-8, disclosed is a jar assembly 10 including a jar 74, and a lid 34 and knife 18 assembly 14. The lid 34 and knife assembly 14 include a lid 34 assembly 78, and a utensil in the form of a knife 18. The lid 34 assembly 78 is adapted to be attached to the jar. In other embodiments, a utensil such as a spoon (not shown) can be used. The knife 18 has a handle 22, a blade 23, and a necked down connecting portion 25 that is attached to and extends between the handle 22 and the blade 23. As is conventional, the jar 74 has a cylindrical portion 26, a closed bottom end 32 and an open upper end 30. The upper end outer surface has a lip 33 or threading (not shown) to permit the lid 34 assembly 78 to be removably attached thereto.

The lid 34 assembly 78 includes a lid 34 and a cylindrical jar sleeve 37 adapted to be secured to the open end of the jar 74. The jar sleeve 37 has a jar sleeve circumferential portion 38 at the upper end thereof.

Figure 2:
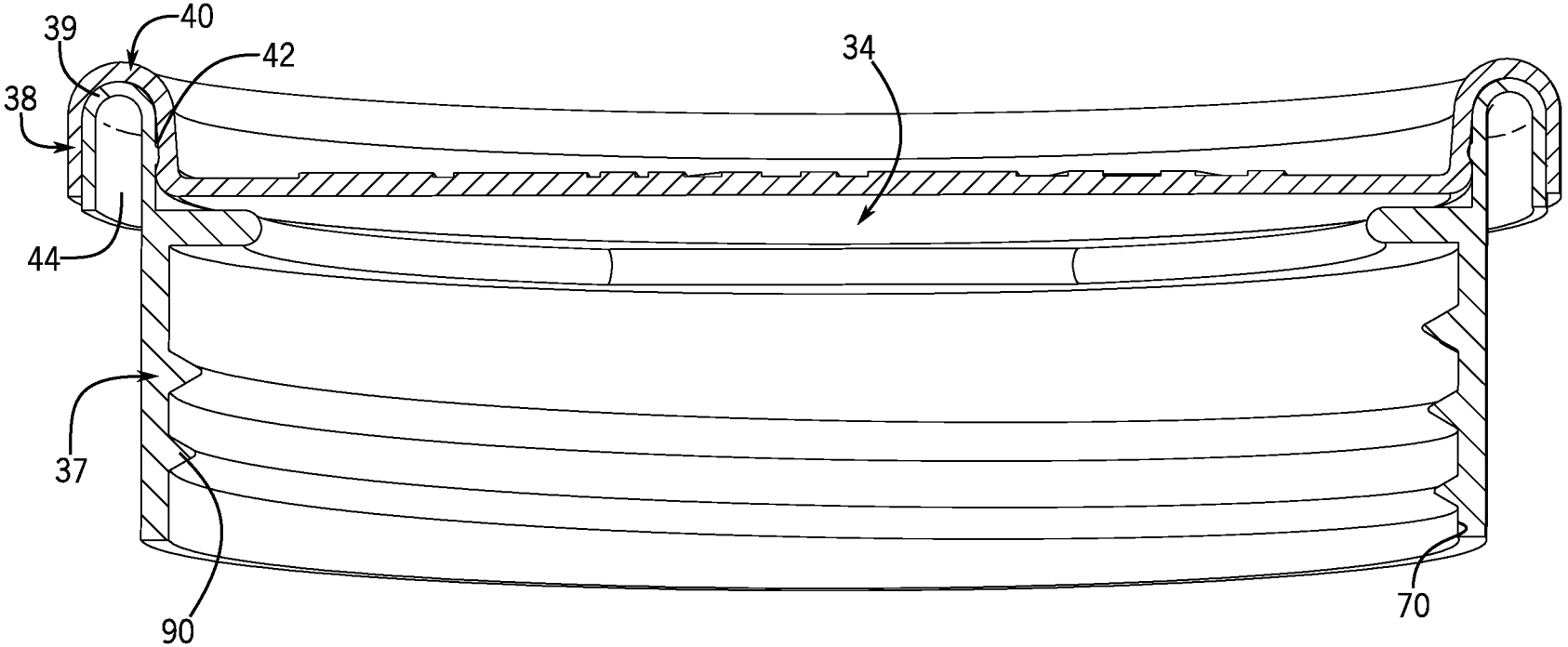
FIG. 2 is a side cross sectional view of a lid receiving a top of a jar sleeve in the lid assembly shown in FIG. 1.
Figure 3:
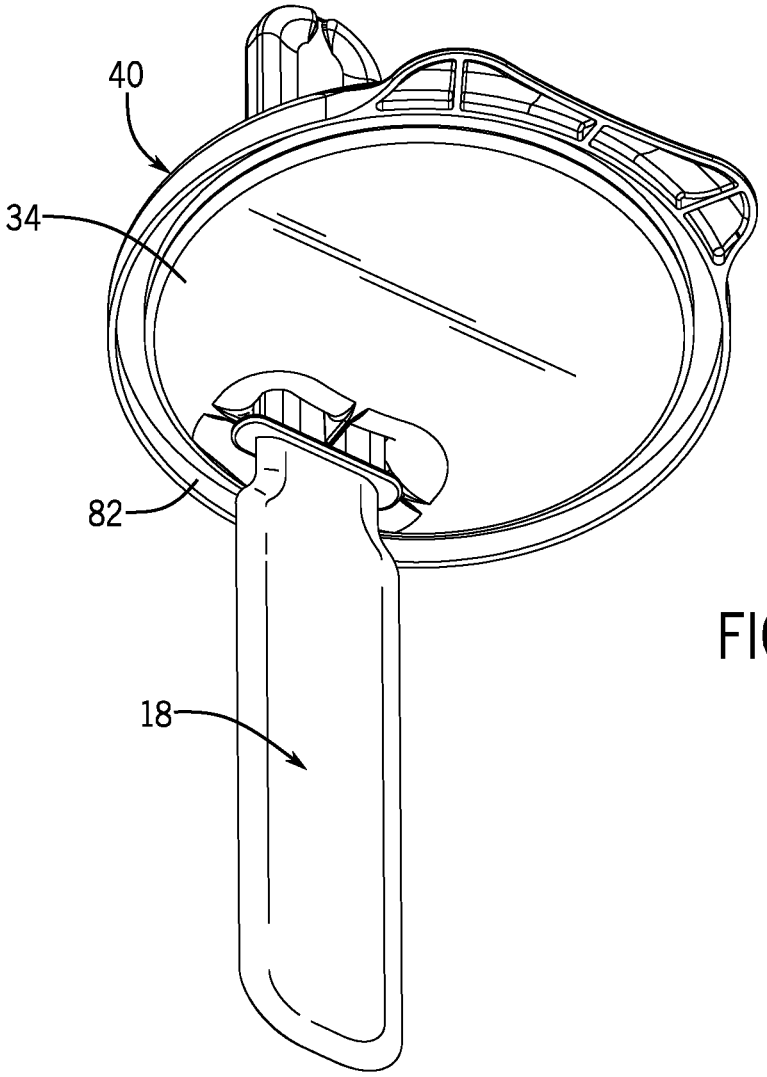
FIG. 3 is a bottom perspective view of a lid and knife in the lid and knife assembly of FIG. 1.
Figure 5:
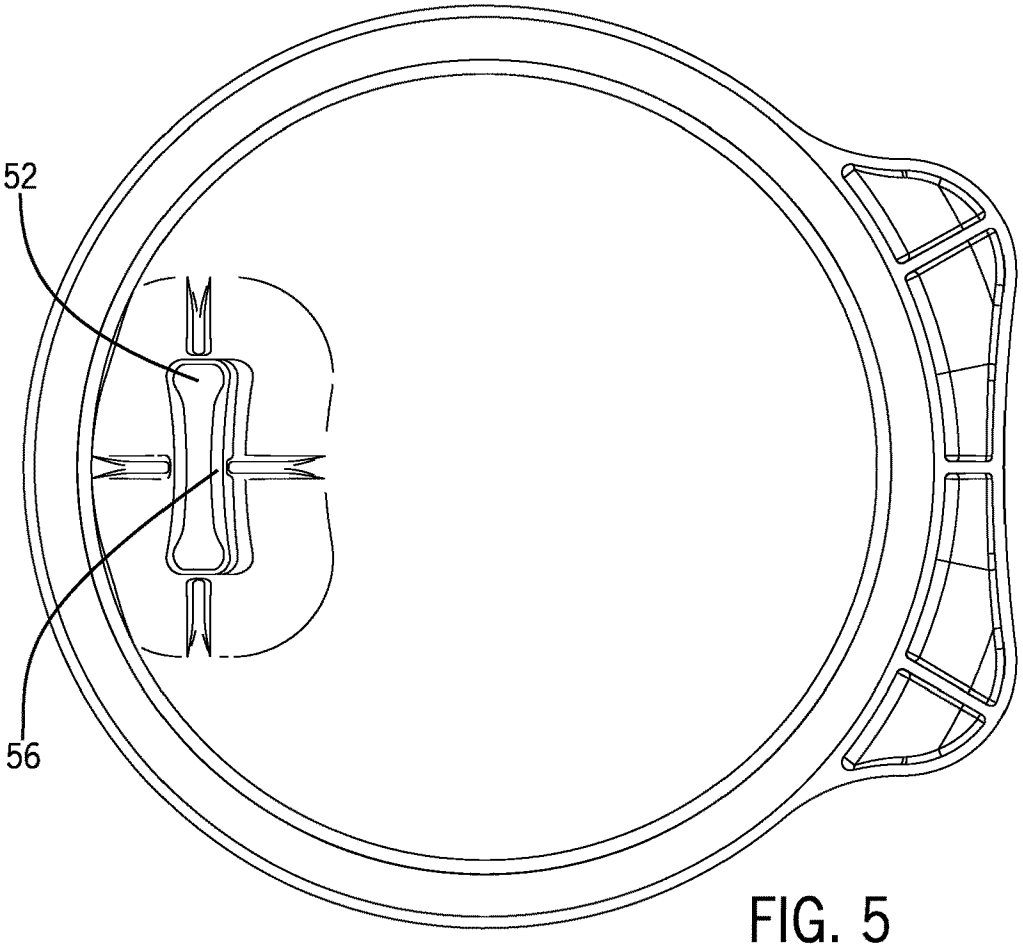
FIG. 5 is a bottom view of the lid.
Figure 4:
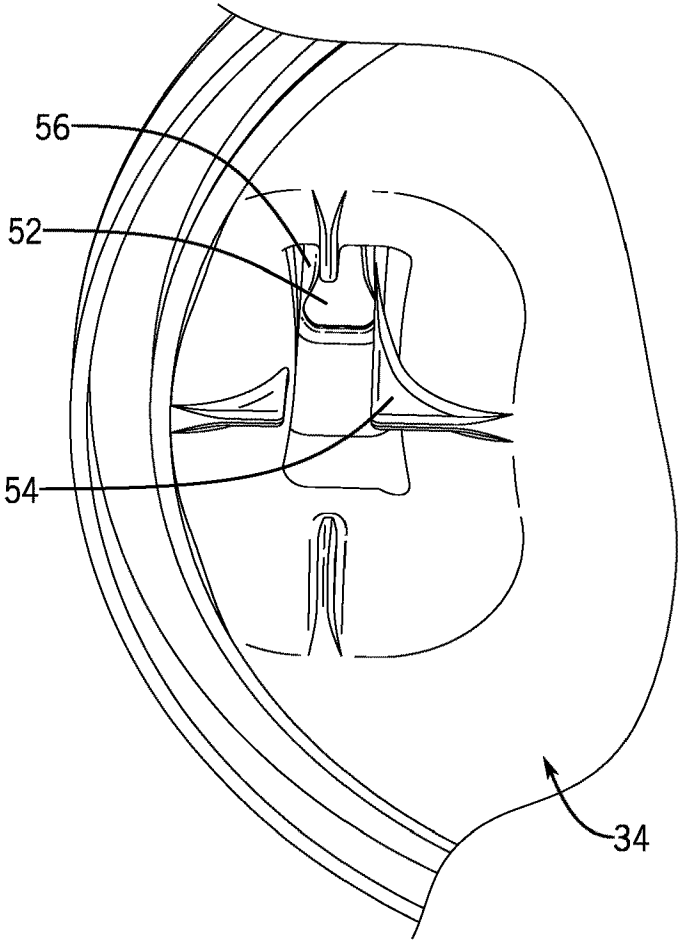
FIG. 4 is an enlarged bottom perspective view of a knife receiving opening through the lid in FIG. 3.
Figure 6:
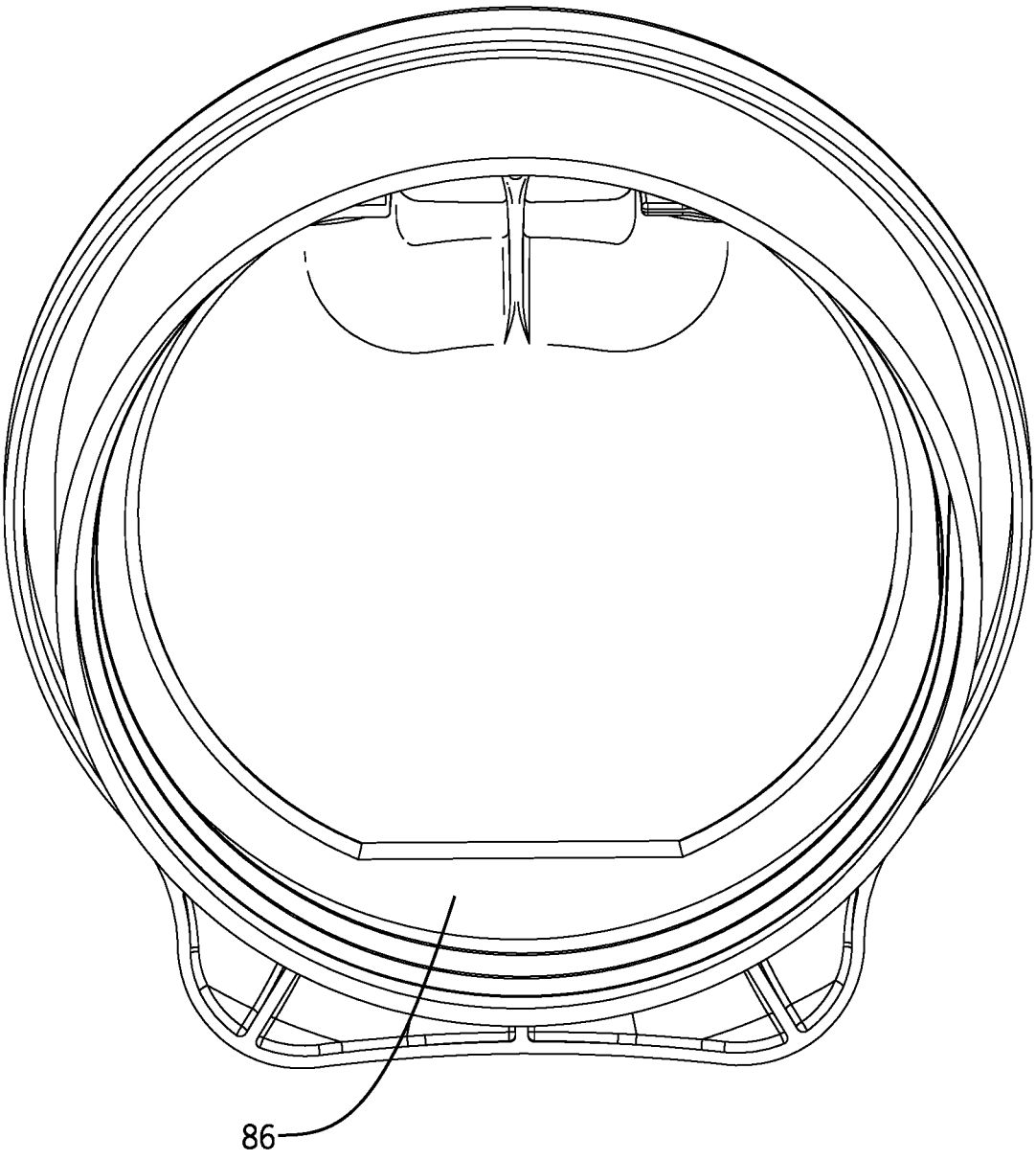
FIG. 6 is a bottom perspective view of the lid and the jar sleeve shown in FIG. 2.

The lid 34 is adapted to be removably attached to the jar sleeve 37 and has a lid circumferential portion 40. As illustrated in FIG. 2, one of the lid 34 and the jar sleeve 37 also has a groove 42 adapted to receive the circumferential portion of the other of the lid 34 and jar sleeve 37. In the illustrated embodiment, the jar sleeve circumferential portion 38 has an upstanding lip 39, and the lid circumferential portion 40 has the groove 42, and the groove 42 is adapted to receive the jar sleeve upstanding lip 39. In the disclosed embodiment, the lid circumferential portion 40 has the lid receiving circumferential groove 40 or pocket the extends continuously around the circumference of the lid 34, the pocket 40 including a pocket opening 44 adapted to receive and hold the jar sleeve upstanding lip 39.

The lid 34 also has a utensil sleeve 46 attached to and extending through the lid 34. As illustrated in FIG. 1, the utensil sleeve 46 has an upstanding portion 50 that defines a utensil receiving opening 52 (see FIG. 4) there through adapted to receive the knife 18. The utensil sleeve upstanding portion 59 has at least one longitudinally extending reinforcing ridge 54 therein to help maintain the knife 18 vertically and to apply sufficient friction without hindering the movement of the knife 18. The utensil sleeve 46 is configured to maintain the knife 18 in a vertical position while having the possibility of moving the knife 18 a certain distance up and down in the jar. The shape of the knife receiving sleeve 46 is adapted to conform to the shape of the knife 18. The utensil sleeve 46 also has a holding rib 56 extending into the utensil receiving opening 52, and the knife 18 has an indentation 58 (see FIG. 1) therein adapted to receive the holding rib 56.

The holding rib 56 and indentation 58 serve to discourage movement of the knife 18 relative to the lid 34, but permits movement of the knife 18 relative to the utensil sleeve 46 when a user so desires.

The knife handle 22 is sized so that it can snuggly pass through the utensil sleeve 46. The knife handle 22 also has an outwardly extending seal 82 extending around the handle 22 near the necked down connection portion 25 that serves to close off the utensil sleeve opening 52 when the knife 18 is placed in the lid 34, thereby closing off the jar 74.

Figure 7:
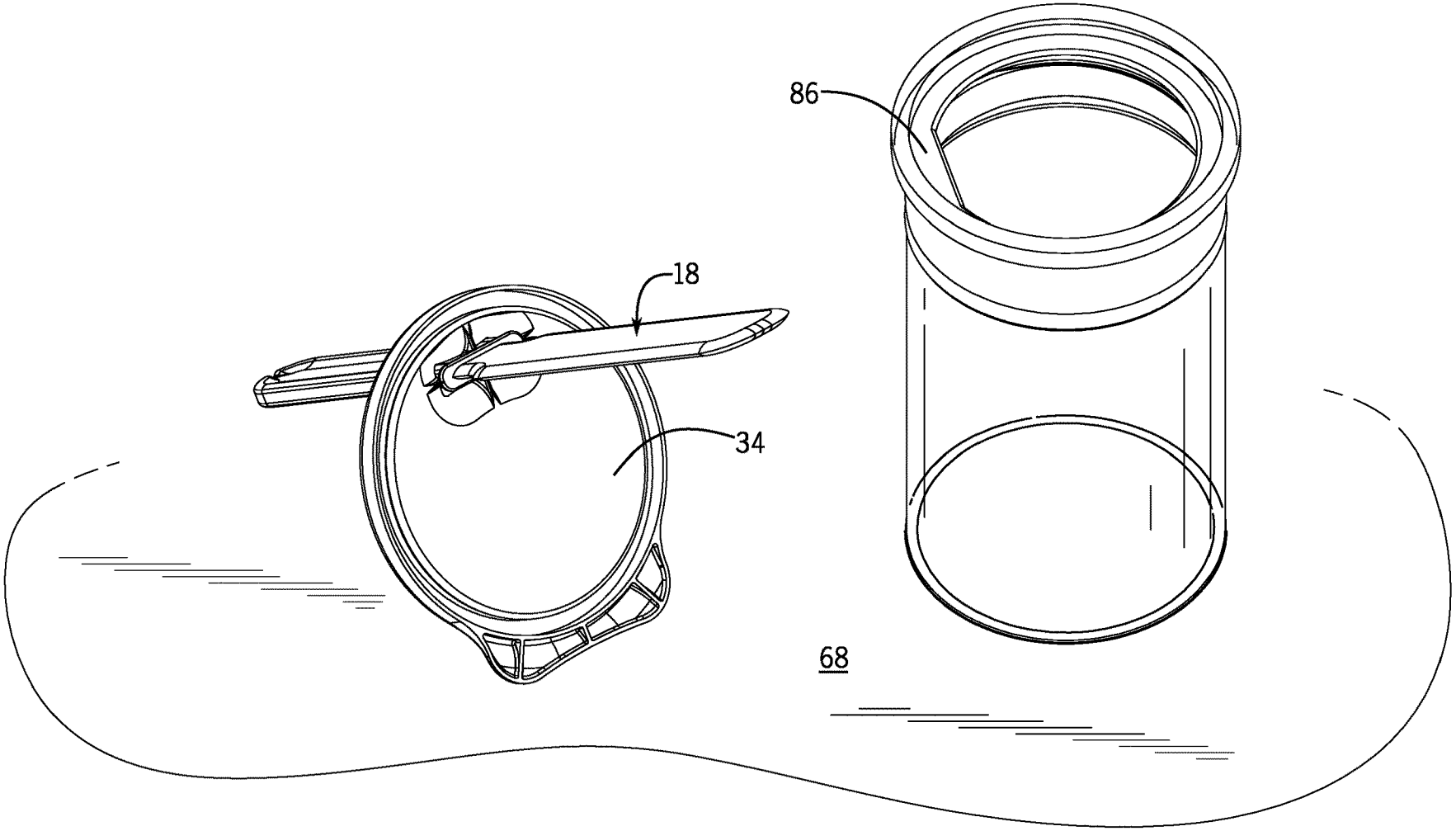
FIG. 7 is a side perspective view of the jar assembly of FIG. 1, with the knife and lid placed on a table.

The lid 34 further includes at least one lid tab 66 extending from the lid circumference on one side of the lid 34. In the illustrated embodiment, there are two spaced apart lid tabs 66 and 66' extending radially outwardly from the lid circumference on one side of the lid 34. The tabs 66 and 66' can act as legs when the lid 34 and knife 18 are placed on a table, as shown in FIG. 7. This helps to keep any contamination that might be on the table surface away from the lid 34 itself. In other embodiments (not shown), there may be only one tab, or even no tabs. The tab or tabs also facilitate removal of the lid 34.

The jar sleeve 37 also has a radially inwardly extending piece 86 on one side of the jar sleeve 37. The inwardly extending piece 86 allows a user to scrape the side of the knife 18 blade against the piece to aid in the removal of material from the blade.

The jar sleeve 37 also has an interior with screw V-threads 90, the screw threads having a major diameter and a minor diameter, the minor diameter of the V-threads becoming smaller as the threads approach the top of the jar sleeve 37. The minor diameter is the lower extreme diameter of the thread. Major diameter minus minor diameter, divided by two, equals the height of the thread. The minor diameter of a nut is its inside diameter. The jar sleeve 37 interior V threads 90 are spiral and are adapted to either mate with a comparable thread or lip 33 on the jar, or to engage a portion of a thread (not shown) found on a comparable sized jar top. In other words, as illustrated in FIG. 2, the minor diameter of the V-threads becoming smaller as the threads approach the top of the jar sleeve 37, i.e., the height of the thread increases. This changing height of the thread 90 encourages thread engagement with jars with different thread diameters and pitches.

The jar sleeve 37 is sized to allow the jar sleeve 37 to fit to the screw portions of jars having various size openings and threading (not shown), or no threading at all. Specifically, the height of the thread on the internal surface of the jar sleeve 37 increases as the spiral thread progresses from the proximal portion (on the jar side) to the distal portion (lid 34 side) of the jar sleeve 37. The jar sleeve 37 is adapted to be secured to the jar for air tightness.

Figure 8:
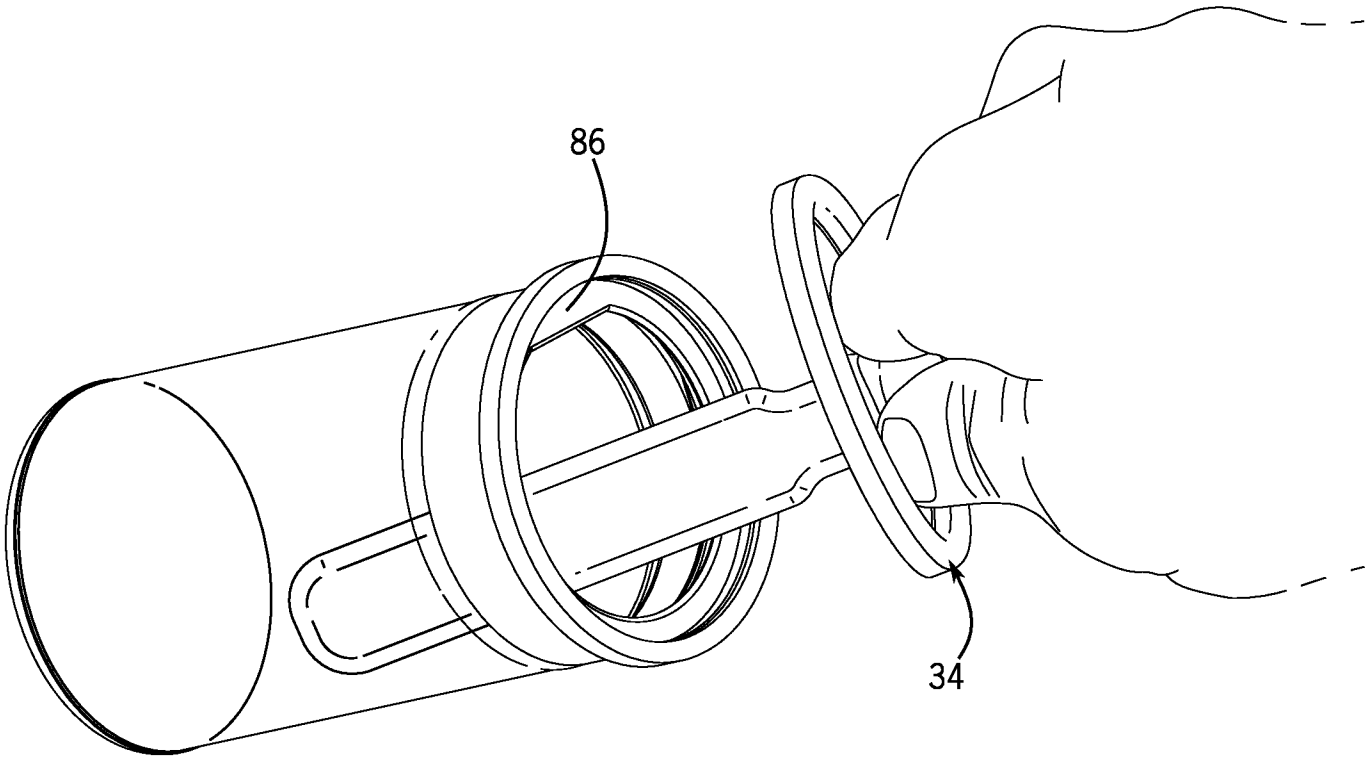
FIG. 8 is a side perspective view of the jar assembly, with a user using the knife to scrape a side of the jar.

In the disclosed embodiment, the knife 18 is formed as a single piece, but in other embodiments, any of the three knife 18 parts can be formed separately and then assembled together. And the necked down portion aids in utilizing the knife 18 to reach under the jar sleeve 37 to reach the top of the walls of the jar 74, as shown in FIG. 8. With the knife 18 still in the lid 34 when a user reaches inside the jar 74, as shown in FIG. 8, the lid 34 acts as a shield, preventing the jar contents from coming into contact with the user.

The disclosed jar assembly 10 thus provides the following advantages. The lid 34 assembly can fit standard sizes of peanut butter and mayonnaise jars on the market. Three sizes are envisaged for different size jars; more specifically, small, medium and large. The tabs extending from the circumference of the lid 34 permit sanitary resting of the knife 18 without contaminating work surfaces or being contaminated. Once in place, a user does not need to be able to twist off the jar lid 34, which is an advantage for the elderly or persons with limited hand mobility. For families or in settings where foods are used often, this product provides a convenient means of accessing and using spreadable products.

Various other features of this disclosure are set forth in the following claims.

The invention claimed is:

1. A lid and knife assembly including:

a knife, and a lid assembly adapted to be attached to a jar, the assembly including:

a longitudinally extending cylindrical jar sleeve adapted to be secured to the open end of the jar and having ajar sleeve circumferential portion at the upper end thereof, and a generally planar lid adapted to be removably attached to the jar sleeve and having a lid circumferential portion not adapted to be hinged to the jar sleeve, the lid having a groove adapted to receive a longitudinally extending portion of the circumferential portion of the jar sleeve at the upper end thereof, a utensil sleeve attached to and extending through the lid not centered in the lid but near an outer edge thereof and adapted to receive the knife, the utensil sleeve providing the only opening through the lid, the lid further includes at least two spaced apart lid tabs extending radially outwardly in the lid planar direction from the lid circumference on one side of the lid opposite from the side of the lid near the utensil sleeve.

2. The lid and knife assembly according to claim 1 wherein the knife has a handle, a blade, and a necked down connecting portion that is attached to and extends between the handle and the blade.

3. The lid assembly according to claim 1 wherein the utensil sleeve has an upstanding portion that defines a utensil receiving opening there through.

4. The lid and knife assembly according to claim 3 wherein the knife handle also has an outwardly extending seal extending around the handle near the necked down connection portion that serves to close off the utensil sleeve opening when the knife is placed in the lid, thereby closing off the jar.

5. The lid and knife assembly according to claim 1 wherein the utensil sleeve has a holding rib extending into the utensil receiving opening, and the knife has an indentation therein adapted to receive the holding rib.

* * * * *